US007267378B2

(12) United States Patent
Drumm

(10) Patent No.: US 7,267,378 B2
(45) Date of Patent: Sep. 11, 2007

(54) MAGNETO-MECHANICAL LOCKING DEVICE

(75) Inventor: Klaus Peter Drumm, Frankenthal (DE)

(73) Assignee: Drumm GmbH, Dettelbach (DE)

( * ) Notice: Subject to any disclaimer, the term of this patent is extended or adjusted under 35 U.S.C. 154(b) by 0 days.

(21) Appl. No.: 11/229,793

(22) Filed: Sep. 19, 2005

(65) Prior Publication Data

US 2006/0049645 A1 Mar. 9, 2006

Related U.S. Application Data

(63) Continuation of application No. PCT/EP04/02883, filed on Mar. 19, 2004.

(30) Foreign Application Priority Data

Mar. 19, 2003 (DE) ..... 103 12 269

(51) Int. Cl.
*E05C 17/56* (2006.01)
*E05C 19/16* (2006.01)

(52) U.S. Cl. ..... 292/251.5; 292/DIG. 60; 70/276

(58) Field of Classification Search ..... 292/251.5, 292/DIG. 60; 70/276; 24/303
See application file for complete search history.

(56) References Cited

U.S. PATENT DOCUMENTS 2,288,688 A * 7/1942 Dubilier ..... 292/144
2,446,336 A * 8/1948 Mark et al. ..... 49/395
2,468,969 A * 5/1949 Galey ..... 292/144
2,524,924 A * 10/1950 Pampallona ..... 292/251.5
2,727,772 A 12/1955 Hamilton
2,797,655 A * 7/1957 Morehouse ..... 109/63.5
2,970,857 A * 2/1961 Squire ..... 292/251.5
3,288,511 A * 11/1966 Tavano ..... 292/251.5
3,334,936 A 8/1967 Hekelaar et al.
3,376,615 A * 4/1968 Heckman ..... 24/303
3,596,958 A * 8/1971 Bowerman ..... 292/201
4,686,841 A * 8/1987 Prunbauer et al. ..... 70/276
4,919,464 A * 4/1990 Richards ..... 292/251.5
5,076,623 A * 12/1991 Richards ..... 292/251.5
5,188,405 A * 2/1993 Maccaferri ..... 292/204
5,367,891 A * 11/1994 Furuyama ..... 63/29.2
5,485,733 A * 1/1996 Hoffman ..... 70/276
6,053,546 A * 4/2000 Frolov ..... 292/251.5
6,640,398 B2 * 11/2003 Hoffman ..... 24/303
6,765,330 B2 * 7/2004 Baur ..... 310/103
2004/0070214 A1 * 4/2004 Queveau et al. ..... 292/251.5

(Continued)

FOREIGN PATENT DOCUMENTS

DE 14 53 25 11/1903

(Continued)

*Primary Examiner*—Carlos Lugo
(74) *Attorney, Agent, or Firm*—Laurence A. Greenberg; Werner H. Stemer; Ralph E. Locher

(57) ABSTRACT

A magneto-mechanical locking device for locking a door can be displaced in relation to a stationary frame. The locking device contains a locking element produced from a magnetizable material and disposed on the frame. The locking device further has a permanent magnet that is mounted on the door and can be twisted from a first release position, in which the locking element is subject to substantially no action of magnetic force, to a second locking position, in which the locking element is attracted by the action of magnetic force of the permanent magnet and locks the door.

22 Claims, 8 Drawing Sheets

U.S. PATENT DOCUMENTS

2004/0222645 A1* 11/2004 Pirone et al. ..... 292/251.5

FOREIGN PATENT DOCUMENTS

DE 24 55 520 5/1976
DE 198 29 958 A1 1/2000
EP 0 367 000 A2 5/1990
JP 5-340 149 12/1993
WO 02/04773 A1 1/2002

* cited by examiner

MAGNETO-MECHANICAL LOCKING DEVICE

CROSS-REFERENCE TO RELATED APPLICATION

This is a continuing application, under 35 U.S.C. § 120, of copending international application No. PCT/EP2004/002883, filed Mar. 19, 2004, which designated the United States; this application also claims the priority, under 35 U.S.C. § 119, of German patent application No. 103 12 269.9, filed Mar. 19, 2003; the prior applications are herewith incorporated by reference in their entirety.

BACKGROUND OF THE INVENTION

Field of the Invention

The invention relates to a magneto-mechanical locking device for the purpose of locking a door or a window. The magneto-mechanical locking device can move with respect to a stationary frame and contains a locking element disposed on the stationary frame and made from a magnetizable material, and a permanent magnet accommodated on the door and can be rotated from a first release position to a second latching position, in which the locking element is attracted by magnetic force effect of the permanent magnet for latching the door.

Doors and windows of buildings, vehicles, items of furniture, safes, etc. are locked in a known manner by mechanically actuated locks, for example by cylinder locks, transverse bolt locks or the like.

There is the problem here that the mechanical locking devices used have a large number of moving parts which interact with one another in order to reliably latch the associated door, the complexity of the mechanical locking devices being greater the higher the requirements placed on the forced entry-inhibiting action of the door or window.

Owing to the large number of moving mechanical parts which are used in locking devices having a high forced entry-inhibiting action, there is the problem, in particular in the case of greater temperature fluctuations, that the shape of the door or window changes and the interengaging mechanical parts no longer interact with a precise fit for latching purposes.

It is therefore often necessary to take care, for example in winter, that doors do not become stuck and can only be closed or opened with a considerable amount of effort.

SUMMARY OF THE INVENTION

It is accordingly an object of the invention to provide a magneto-mechanical locking device that overcomes the above-mentioned disadvantages of the prior art devices of this general type, which has a small number of parts to be produced and which always ensures reliable operation even in the case of great temperature fluctuations.

In accordance with the invention, a magneto-mechanical locking device for the purpose of locking a door, which can move with respect to a stationary frame, for example an automobile door, a building door, a safe door or else a window, contains a locking element, which is disposed in the frame and is made from a magnetizable material, for example from magnetizable steel or iron, and interacts with a permanent magnet fixed to the door. In this case, the permanent magnet is, according to the invention, accommodated on the door or on the window such that it can be rotated, and can preferably be rotated mechanically by hand from a first, release position, in which substantially no magnetic force effect is exerted on the locking element, to a second, latching position, in which the locking element on the stationary frame is attracted by the magnetic forces exerted by the permanent magnet and latches the door or window in its closed position.

For reasons of simplicity, the description of the invention below refers to a door, although the described advantages and embodiments also apply to windows in a corresponding manner.

The invention provides the advantage that, owing to the remote action of the magnetic forces, there is compensation even for greater fluctuations in the distance between the frame-side locking element and the magnet, such as are produced, for example, by temperature fluctuations depending on the time of year.

A further advantage of the apparatus according to the invention relates to the fact that it operates virtually without wear and, in comparison to the mechanical locking devices, only has a very small number of moving parts. As a result, in particular when manufacturing the magneto-mechanical locking device according to the invention, considerable costs can be saved, since the tolerances of the individual parts can be selected to be greater than those for mechanical locking devices having a comparable standard of security.

In accordance with one preferred embodiment of the invention, which allows for particularly reliable latching of a door or window, projections, which engage, in the latching position, in associated receptacles of the door and, as a result, produce an interlocking connection activated by the magnetic forces, are formed on the locking element. The projections are preferably formed by pins or tabs, which engage in associated holes or grooves in the door, the holes or grooves preferably extending over the entire length of the locking element.

In this case, the locking element is preferably formed by a striking plate, which can move relative to the stationary frame of the door or window and, in the second, latching position, enters into an interlocking connection with the permanent magnet or with the associated part of the door, which connection latches the door or window.

In accordance with a further embodiment of the invention, the locking element may be formed by a locking bolt, which is accommodated linearly in a guide hole formed in the frame such that it can move. This results in a cost-effective configuration of the locking device according to the invention that is particularly simple in mechanical terms.

In accordance with a further refinement of the concept on which the invention is based, further permanent magnets, which produce a magnetic force which is less than that of the permanent magnet on the door, are disposed on that side of the locking element which is remote from the door. The size and the magnetic field of the further permanent magnets are in this case selected such that, in the latching position, the locking element is attracted by the permanent magnet of the door and latches the door, but, in the release position, on the other hand, is forced away from the door by the further permanent magnets and releases the latching of the door. Owing to this refinement of the invention, which is advantageously subject to virtually no wear, a further reduction in the mechanical parts used results.

However, it is likewise possible in the same way for a spring-elastic device, for example a spiral tension spring, to be used instead of the further permanent magnet, the spring-elastic device forcing the locking element away from the door in the same way in the release position, in which no or virtually no magnetic field is present in the region of the locking element, and, as a result, canceling the latching action. In the latching position, the locking element is then attracted towards the door, counter to the action of the spring-elastic device, owing to the considerably greater magnetic forces of the permanent magnet until it bears against the door edge or the magnet.

In the preferred embodiment of the invention, the permanent magnet is formed by a cylindrical or rod-shaped magnet, which is preferably polarized in the transverse direction, i.e. in the direction perpendicular to the longitudinal axis of the magnet, and is accommodated in a housing, which is substantially closed in the circumferential direction and is made from a magnetizable material, for example iron. The hole formed for this purpose in the housing has a slightly larger diameter than the magnet and preferably at the same time is used for mounting the magnet.

The magnet may be formed from a known permanent magnet material, for example from ferrite, or else, in a particularly expedient embodiment, from cobalt samarium or another rare earth material, which produces a very high magnetic force.

The use of a rod-shaped or cylindrical permanent magnet, which is accommodated in a closed housing such that it can rotate, results in the advantage that unlatching and latching of the door only requires a very low actuation force or, to be precise, a very small torque, since, with the exception of the frictional forces when moving the locking element in the direction towards the magnet and the frictional forces, which are produced by the mounting of the rod-shaped permanent magnet, no mechanical frictional forces are produced whatsoever. As a result, it is likewise not necessary to oil the entire mechanism or to make the mechanism smooth in another complex way by corresponding selection of the materials, since the forces for latching the door or the window are transferred by the remote action of the magnetic forces alone.

Furthermore, provision may advantageously by made for the latching effect to be produced by the fact that the locking element engages directly in a cutout formed in the housing of the permanent magnet in order to obtain an interlocking connection, which is protected against manipulations from the outside, for the purpose of latching the door. This results in a particularly cost-effective refinement of the invention, since the permanent magnet, together with the housing, can be used as one unit in a correspondingly shaped cutout in the door, without additional components being required.

In this embodiment of the invention, the magnet can advantageously also be fixed from the inside of the door with the aid of screw bolts, which are passed through longitudinal holes formed in the housing of the magnet and can be screwed into corresponding thread holes in a door fitting in a known manner, the door fitting being disposed on the outside of the door for the purpose of protecting the locking mechanism. As a result, a locking device can be achieved with very little complexity, which can be produced in a very cost-effective manner owing to the small number of mechanical components and can be retrofitted in existing doors using simple measures with effective protection against the door being broken open.

In accordance with a further embodiment of the invention, the alignment of the permanent magnet in the housing is preferably such that the longitudinal axis of the permanent magnet extends substantially perpendicular to the plane of the door. In other words, the permanent magnet extends through the door leaf in the same manner as a conventional locking cylinder in the region, in which the door lock is generally disposed. The permanent magnet in this case preferably has a length, which is slightly less than the thickness of the door leaf, it being possible, however, for provision likewise to be made for the length of the magnet to be selected to be slightly larger, and the housing of the magnet to be drawn out of the door leaf, in particular towards the inside of the door, in order to obtain increased magnetic force, with which the locking element is attracted so as to latch the door.

The permanent magnet is preferably rotated back and forth between the release position and the latching position by an actuating element, which can rotate mechanically, on the outside of the door, it being possible for the actuating element, in the simplest refinement of the invention, to be provided with a knob, which is preferably covered by a protective fitting fitted on the outside of the door. This results in the advantage that the locking device for the purpose of latching the door can be configured to be completely independent of the function of the protective fitting, with the result that the encoding for the purpose of opening the door is determined by the protective fitting alone, while latching of the door takes place in the manner described above with the aid of the magnet.

In the preferred embodiment of the invention, the magnet, which has been inserted in the door in the manner described above, is driven, however, with the aid of a protective fitting, for example a viewing fitting or else a core protective rosette, as is produced by the applicant, and is described, for example, in the German utility model DE 93 17 012 U1. In this case, the permanent magnet is coupled to the outer part, which can rotate, of the protective fitting via a known polygonal shaft, for example a square shaft, the center of rotation of the protective fitting being disposed on the extension of the central mid-axis of the permanent magnet. The magneto-mechanical locking device according to the invention, which is actuated in this manner with the aid of a preferably circular protective fitting, which can rotate, (also referred to below as a protective rosette) offers, along with a very simple configuration, excellent protection against the door being broken open and is also characterized by a very long life, since the locking mechanism as such is subject to virtually no wear.

In the same manner, there is the possibility of rotating the cylindrical permanent magnet with the aid of a displaceable protective fitting, as is manufactured, for example, by the Applicant and is described in the European patent EP 0 367 000 B1. For this purpose, the displaceable part of the protective fitting, for example on its inside, may be provided with a linear toothed section in the form of a toothed rack, which is in engagement with a pinion, which is accommodated on a shaft, which may be fixed to the permanent magnet in the region of its center of rotation.

In this embodiment of the invention too, at the same time as the insertion of the key, which has specially been provided with pins, in the protective fitting and displacement of the same owing to the toothed engagement, the permanent magnet is rotated from the latching position to the release position and thus the locking device according to the invention is unlatched, since, in the release position, the magnetic field, which acts on the locking element, within the housing of the magnet is changed such that the region outside the permanent magnet has virtually no field, with the result that no force is exerted on the locking element any more.

In order to latch the door, the protective fitting is displaced back to the initial position, and the key is removed from the protective fitting, in which case, owing to the interaction of the pinion and the toothed rack and the movement of the displaceable part of the protective fitting, the magnet is rotated through approximately 90° back to the latching position, in which the striking plate is attracted by the magnetic field caused by the permanent magnet with a very high force in the direction of the magnet, and latches into the corresponding projections there in order to latch the door.

However, in the same way it is likewise possible for the permanent magnet to be rotated with the aid of a conventional locking cylinder or profile cylinder, which may extend, for example, into the interior of the permanent magnet and is connected to the permanent magnet such that it is fixed against rotation.

In accordance with a further embodiment of the invention, provision may be made for an electromechanical coupling to be provided between the actuating element, which can rotate, on the outside of the door and the magnet, the electromechanical coupling being coupled in a known manner to electronics, which can be activated, for example, with the aid of an encoded microchip in order to supply the electromechanically lockable coupling with an electrical voltage such that the electromechanically lockable coupling latches in so as to open the door. Such an electromechanical coupling is known, for example, from published, non-prosecuted German patent DE 198 29 958 A1.

Owing to the combination of the magneto-mechanical locking device according to the invention and the electromechanical coupling disposed between the actuating element on the outside of the door and the permanent magnet, the advantage results that the large number of encoding possibilities and the high degree of safety against manipulation of a purely electronic locking device are combined with the advantages of the above-described magneto-mechanical locking device. In this case, it is of particular advantage that the forces for the purpose of rotating the magnet are very low in comparison with known mechanical locks, even in the case of doors having a larger number of locking devices according to the invention, owing to the lack of frictional forces. As a result, both the dimensions of the electromechanical coupling and the current consumption can be kept comparatively low.

In accordance with a further refinement of the concept on which the invention is based, the longitudinal axis of the rod-shaped or cylindrical permanent magnet is aligned substantially parallel to the vertical, and extends substantially parallel to and in the vicinity of the door edge. For this purpose, the rod-shaped permanent magnet can be inserted in a corresponding pocket or cutout, which is disposed at one end in the door in the region of the vertically extending door edge. In this context, it is likewise conceivable for a rod-shaped permanent magnet, which ensures latching of the door in the region of the upper door edge, to be provided in the same way in the region of the horizontally extending, upper door edge.

In this embodiment of the invention, the rod-shaped permanent magnets have a comparatively small diameter of, for example, 2 to 5 cm and an accordingly long length of up to 20 cm or more, and are advantageously rotated by a gear mechanism, which is coupled to the actuating element (which can be rotated) and may be, for example, a bevel gear mechanism or another angular gear mechanism.

The above-described embodiment of the invention has the advantage that both the two vertically extending door edges and the horizontally extending, upper door edge, which is disposed on the upper side of the door, can be used for the purpose of latching the door if two or more magnets are disposed along the edges of the door such that they are coupled via corresponding angular gear mechanisms and the associated regions of the door frame are provided with corresponding striking plates, which are attracted towards the door when the permanent magnets are rotated from the release position to the latching position, in order to latch the door by producing an interlocking connection. At comparatively low actuating forces, a locking device thus results which makes possible highly effective, two-dimensional latching over virtually the entire length of the door edge.

This embodiment of the invention may provide for two or more permanent magnets to be coupled to one another, via corresponding shafts, such that they are fixed against rotation, it being possible for the coupling to take place, for example, in the corner regions of the door edge by correspondingly configured bevel gear mechanisms or other angular gear mechanisms. A further advantage of this embodiment relates to the fact that the locking device may be of modular configuration in the form of a construction kit, in which case any desired number of rod-shaped permanent magnets are connected to one another via associated shafts, for example by being inserted one inside the other, such that they are rigid in terms of rotation in order to equip a door, a window or the like with a desired number of magnets.

In accordance with a further embodiment of the invention, the door or window may in this case be provided in a very simple manner with a self-latching mechanism, by which the permanent magnet in its housing is automatically rotated from the release position to the latching position when the door is closed.

The self-latching mechanism in this case preferably contains a toothed rack, which grips the permanent magnet or a shaft, which is coupled to the permanent magnet such that it is fixed against rotation, via a corresponding pinion, is preferably accommodated in a linear guide in the door and rotates the magnet to the latching position when the toothed rack is displaced in the direction towards the locking element, with the result that the magnetic forces are automatically activated when the door is closed and attract the locking element for the purpose of latching the door.

The toothed rack is preferably driven via a third permanent magnet, which is, for example, connected to the door frame-side end of the toothed rack and is moved out of the door in the direction towards the locking element when the door is closed owing to a part, which is made from a magnetizable material, for example from an iron plate, of the door frame or else the locking element itself, and as a result moves the toothed rack which for its part again rotates the permanent magnet to the latching position.

It is possible in the same way to produce automatic rotation of the permanent magnet to the latching position via a lever configuration or the like, which acts on the axis of rotation of the magnet and is likewise actuated by the third permanent magnet.

This results in a latching mechanism, which operates virtually without wear without the otherwise conventional, very high mechanical complexity and which functions reliably even in the case of greater temperature fluctuations in the event of a change in the distance between the door and the door frame.

In accordance with a further refinement of the concept on which the invention is based, the housing of the permanent magnet or, generally, the permanent magnet may be surrounded by an electrical coil, in the case of which the coil turns are disposed such that the permanent magnet can be rotated back and forth between the latching position and the release position depending on the direction of an electrical current flowing through the coil. In the preferred embodiment, the coil turns are wound around the housing of the permanent magnet for this purpose such that the longitudinal axis of the coil preferably extends perpendicular to the longitudinal axis of the in this case likewise, if possible, rod-shaped permanent magnet. However, in the same way, other configurations of the coil, through which current flows, are also conceivable.

This embodiment results in the advantage that the door, for example in the embodiment as a fire-escape door, is opened automatically and centrally in the event of a fire, or, in the embodiment as a fire door, can be latched electrically and automatically without the permanent magnet needing to be rotated by hand for this purpose.

In accordance with a further refinement of the invention, a displaceable transverse bolt is accommodated on the door in a known manner, the transverse bolt interacting with the permanent magnet via, for example, a further magnet, to be precise such that the transverse bolt is likewise moved to its latching position when the permanent magnet is rotated from the release position to the latching position, as a result of the magnetic force effect. In this case, the magnetic force effect may be produced, for example, by one or more disk-shaped or rod-shaped permanent magnets, which are disposed on that side of the permanent magnet which is opposite the locking element and are moved away from the housing of the permanent magnet, counter to the tensile action of a spiral tension spring or a similar spring-elastic device, when the magnet is rotated to the latching position, owing to the magnetic field produced, with the result that the transverse bolt can engage in a known wall receptacle, which is disposed on that edge of the door frame which lies in the region of the door hinge. The transverse bolt is drawn back out of the wall receptacle in order to release the door in this case once the magnet has been rotated to the release position, at an increased magnetic force owing to the spring-elastic device.

Finally, a further embodiment of the invention may provide for a pin-shaped or hook-shaped projection, which may have, for example, a T-shaped head and engages in a circumferential accommodating groove (which is formed in a corresponding manner in the magnet and extends towards the center of the magnet such that the, for example, T-shaped head engages in the groove and latches the door in an interlocking manner in addition to the magnetic forces and the interlocking connection of the locking element in the region of the magnet), to be provided on the striking plate or on the locking bolt.

The circumferential accommodating groove with the cross section extending towards the interior of the magnet may also, however, engage in the same way in a section, which is connected to the magnet such that it is fixed against rotation, is made from a cured material and is rotated together with the magnet.

Finally, provision may be made for a seal, for example made from rubber or another known sealing material, to be disposed over the entire length of the locking element, the seal moving in the direction towards the door together with the striking plate, with the result that the sealing effect is advantageously produced by the magnetic force effect of the permanent magnet on the locking element. This results in the advantage that reliable sealing of the door or also, possibly, a window is always ensured even in the case of greater changes in the distance between the door frame and the door as a result of seasonal temperature fluctuations.

Although the invention has already been described in conjunction with a permanent magnet, which is accommodated on the door such that it can rotate, and a locking element, which is provided on the stationary door frame and is made from a magnetizable material, the invention in the same way contains the reverse design, in which the permanent magnet is fixed to the stationary frame such that it can be rotated, and the locking element is preferably accommodated on a door or a window such that it can move.

Other features which are considered as characteristic for the invention are set forth in the appended claims.

Although the invention is illustrated and described herein as embodied in a magneto-mechanical locking device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
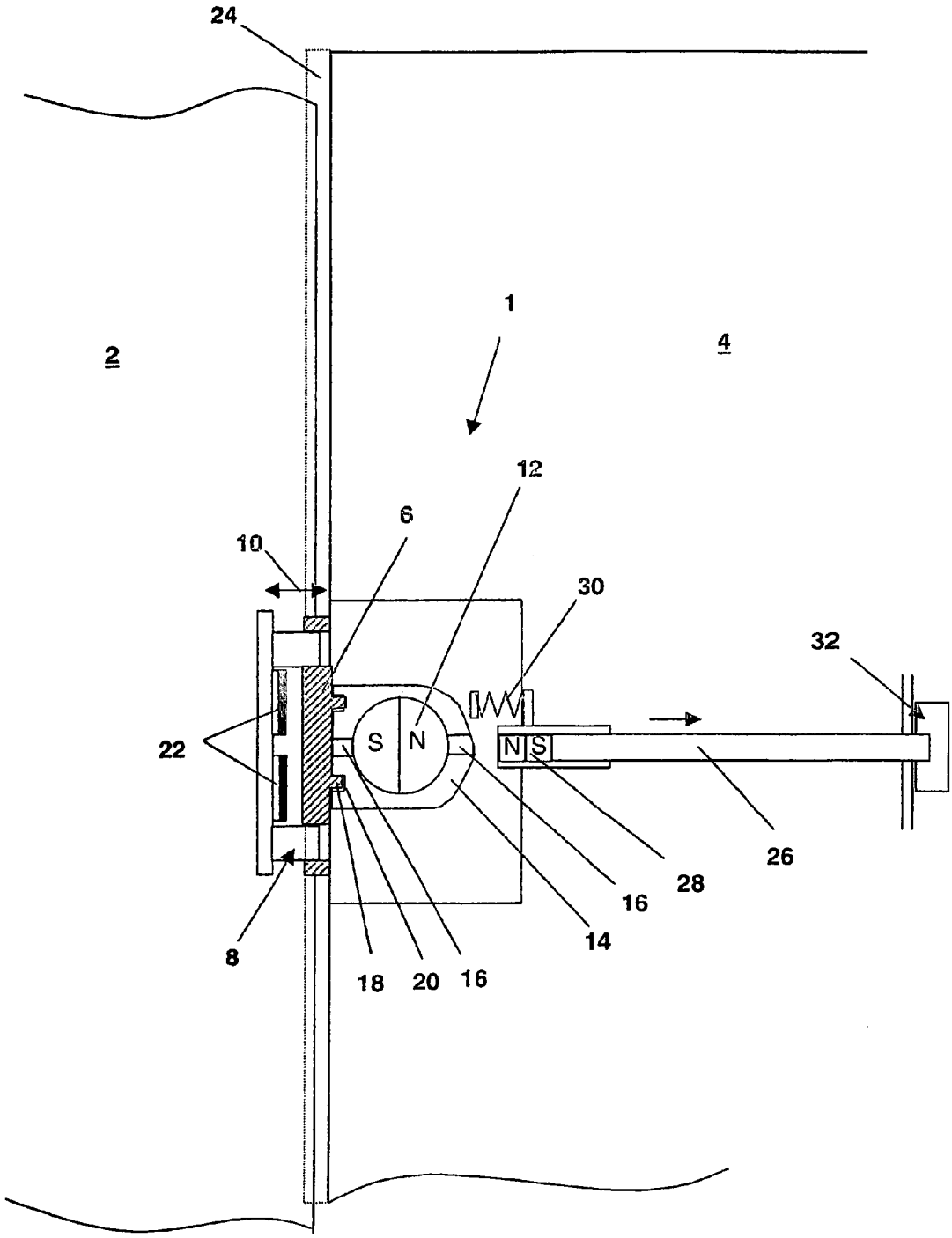
FIG. 1 is a diagrammatic, sectional view of a first embodiment of a locking device according to the invention having a locking element, which is accommodated on a door frame such that it can move and is forced away from the door by further permanent magnets, and has a transverse bolt, which is likewise actuated by the permanent magnet, in the latching position.

Referring now to the figures of the drawing in detail and first, particularly, to FIG. 1 thereof, there is shown a magneto-mechanical locking device 1 according to the invention for the purpose of locking a door 4, which can move with respect to a frame 2, and contains a locking element 6, which is fixed to the frame 2 such that it can move via a guide 8 in the direction of arrow 10.

The locking device 1 according to the invention also contains a rod-shaped permanent magnet 12, which is accommodated in a housing 14 made from a magnetizable material such that it can be rotated. Such a magnet is known from the prior art, for example for holding tripods for photographic apparatus or dial test indicators or the like.

Nonmagnetic, strip-shaped regions 16 are preferably disposed in the magnet housing 14, which regions may be made from, for example, aluminum and influence the magnetic field produced such that, when the magnet is rotated to the latching position illustrated in FIG. 1, a magnetic force is exerted on the locking element 6 by the magnetic material via the housing 14 of the magnet and this force attracts the locking element 6 in the direction towards the housing 14 such that projections 18 formed on the locking element 6 engage in associated grooves or cutouts 20 in the door 4 or in the magnet housing 14 and form an interlocking connection which prevents the door 4 from being opened.

Figure 2:
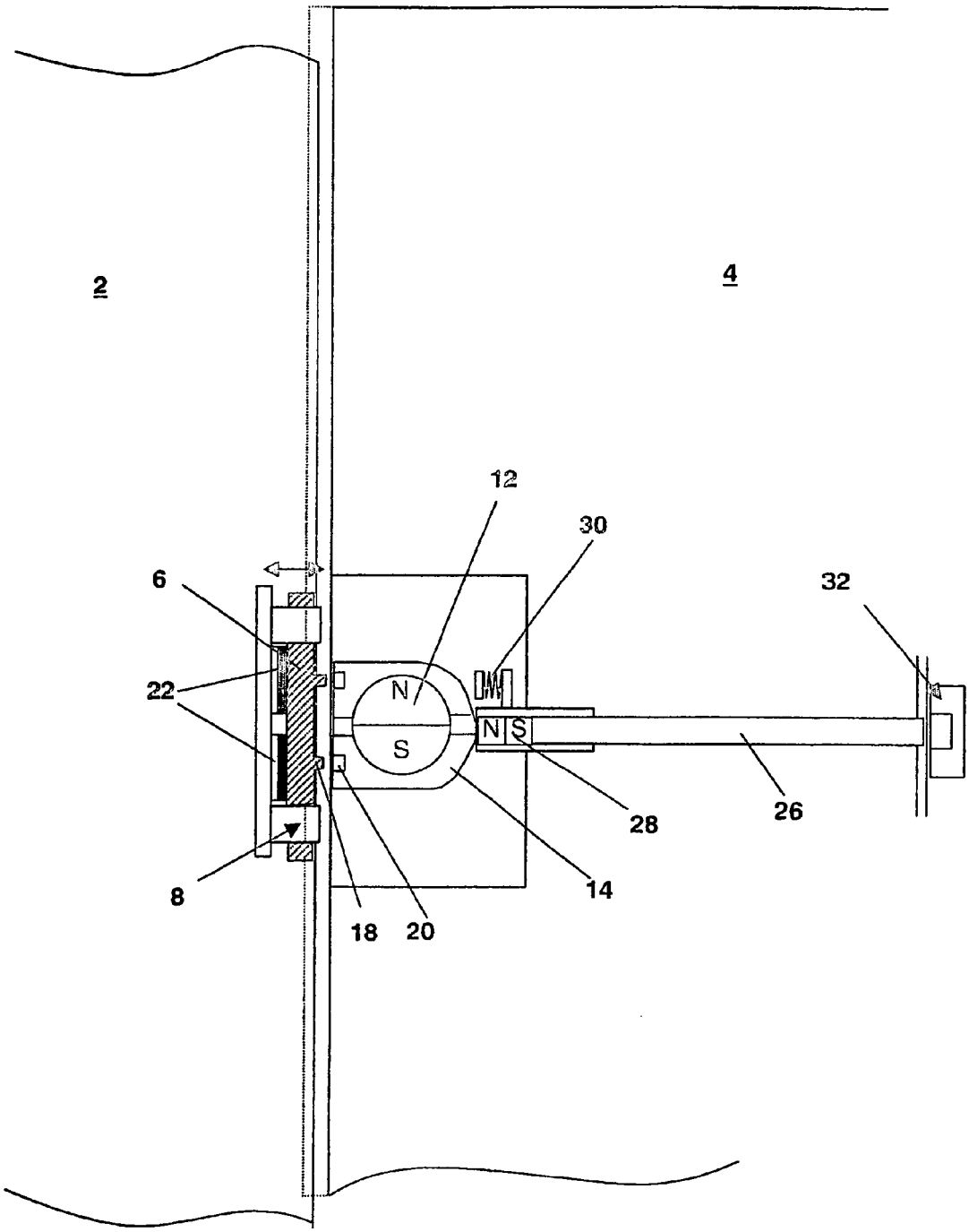
FIG. 2 is a diagrammatic, sectional view of the first embodiment from FIG. 1 in a release position.

In order to cancel the latching of the door 4, the magnet 12 is rotated from the latching position shown in FIG. 1 to the release position illustrated in FIG. 2, in which, owing to the properties of the field strength distribution of the magnetic field, which distribution is influenced by the nonmagnetic regions 16, the magnetic force is canceled in the region of the locking element 6. In the position illustrated in FIG. 2, the locking element 6 made from a magnetizable material is moved away from the housing 14 of the magnet 12 by one or more further permanent magnets 22, which are disposed on the rear of the locking element 6 and produce a magnetic force which is considerably less than the magnetic force produced by the permanent magnet 12 in the latching position. As a result, the door 4 is unlatched and can be opened in the usual manner, for example with the aid of a door handle.

As can also be seen in FIGS. 1 and 2, a door rabbet 24 is formed in a known manner on the door 4, the rabbet 24 protecting the bearing region, in which the locking element 6 bears against the door 4 or against the housing 14 of the magnet 12, from manipulations from outside.

Owing to the very strong attraction forces between the locking element 6 and the permanent magnet 12 in the latching position, extremely effective latching results which can only be canceled in a very complex manner by external manipulations.

As is also illustrated in FIGS. 1 and 2, a transverse bolt 26 may also be disposed on the inside of the door 4, the transverse bolt 26 being provided, at its end facing the magnet 12, with a third magnet 28, which is repelled in the latching position shown in FIG. 1 by the field of the rod-shaped permanent magnet 12 and moves the transverse bolt away from the permanent magnet 12, counter to the action of a tension spring 30, to the latching position shown in FIG. 1, in which the second end of the transverse bolt 26 engages in an associated wall receptacle 32 in order to offer additional protection against the door 4 being taken off its hinges.

Figure 3:
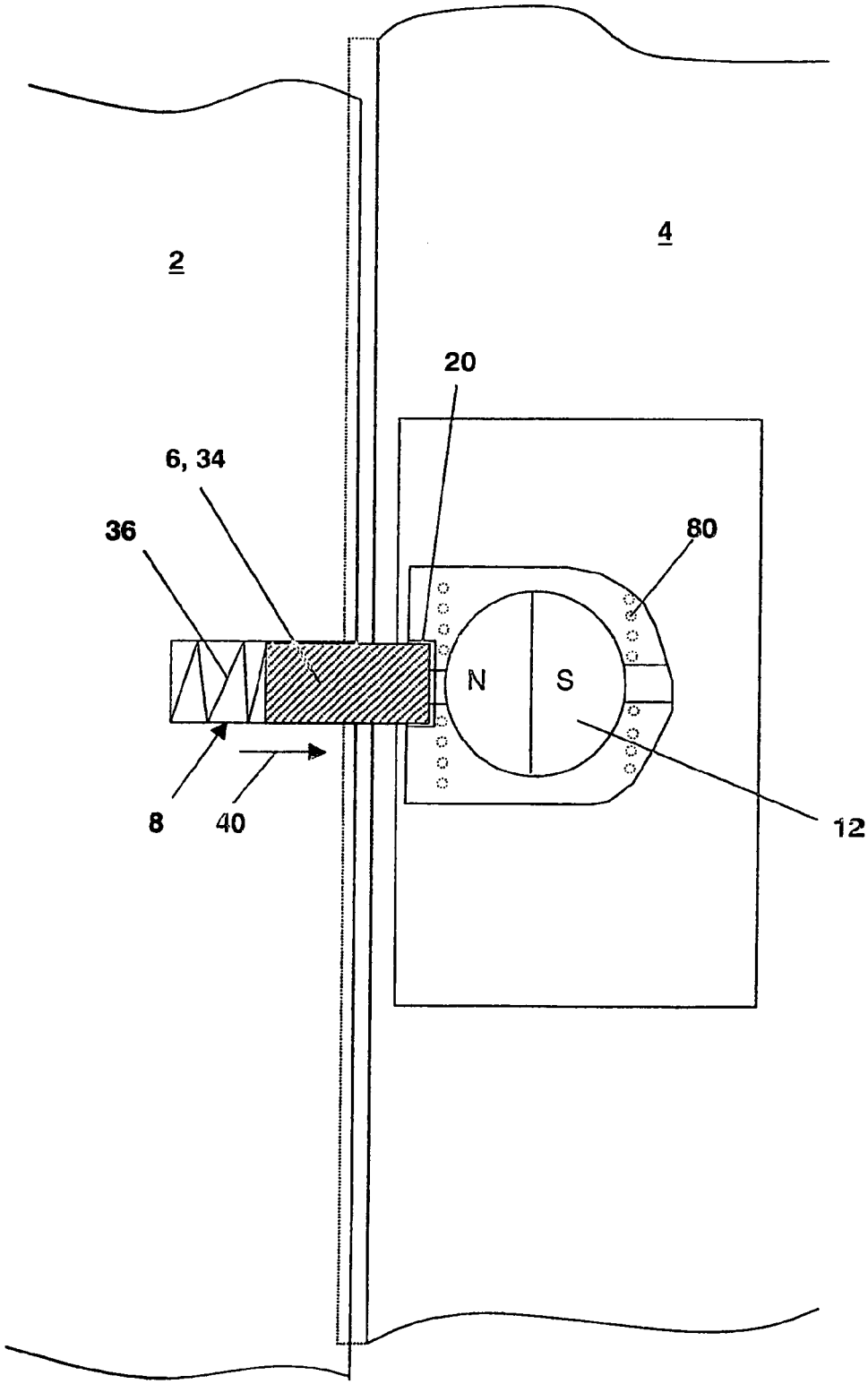
FIG. 3 is a diagrammatic, sectional view of a second embodiment of the apparatus according to the invention having a bolt-shaped locking element, which engages in a cutout formed in a housing of a rod-shaped permanent magnet, in the latching position.
Figure 4:
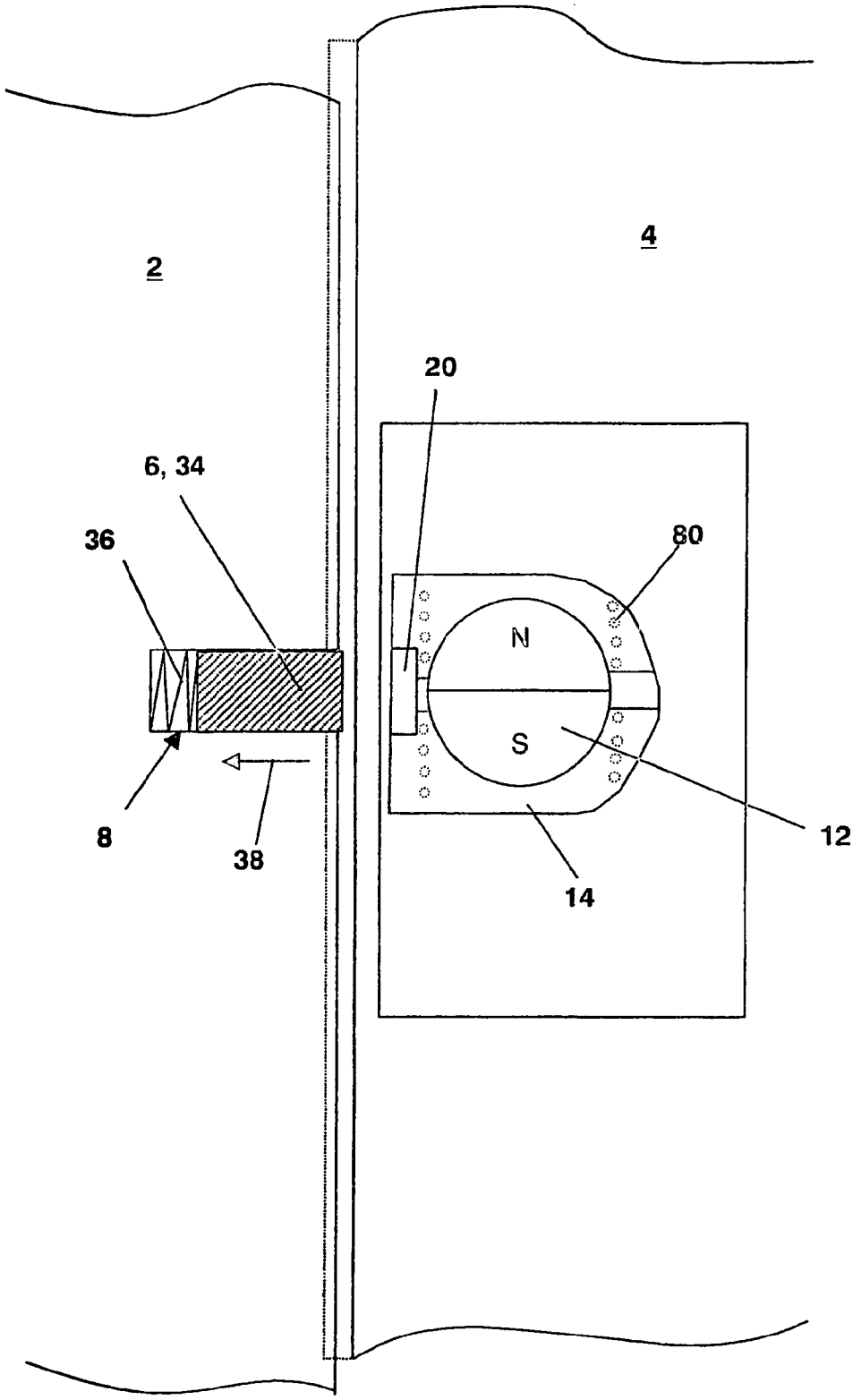
FIG. 4 is a diagrammatic, sectional view of the second embodiment from FIG. 3 in the open position.

In the embodiment of the invention illustrated in FIGS. 3 and 4, the locking element 6 is in the form of a locking bolt 34, which is guided in the associated guide 8 in the frame 2 and is forced away from the door 4 in the direction of the arrow 40 by a tension spring 36 or else an additional permanent magnet (not illustrated in any more detail).

The other end of the bolt-shaped locking element 34 is matched in terms of its shape to the cutout 20 formed in the door 4 or in the housing 14 of the magnet 12, the end engaging in the cutout 20 in an interlocking manner if the bolt-shaped locking element 34 is moved in the direction of the arrow 40 from the release position shown in FIG. 4 to the closed position shown in FIG. 3 owing to the magnetic forces once the magnet 12 has been rotated.

Figure 5:
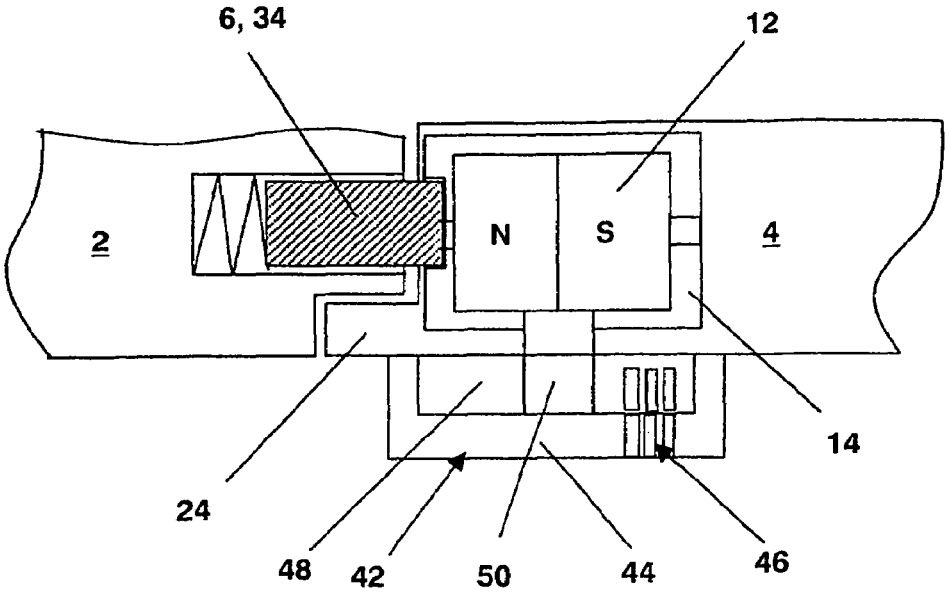
FIG. 5 is a diagrammatic, cross-sectional view of a third embodiment of the invention, which is similar to the embodiment from FIGS. 3 and 4 and in which the permanent magnet is rotated by a rosette-shaped protective fitting, which can rotate, on the outside of the door, in the latching position.
Figure 6:
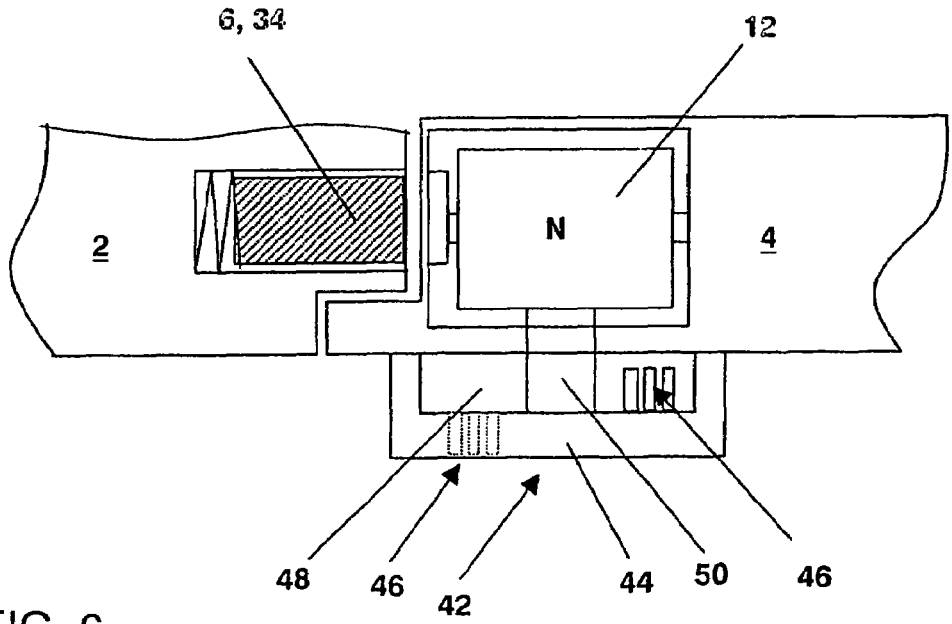
FIG. 6 is a diagrammatic, cross-sectional view of the third embodiment from FIG. 5 in the release position, once the protective fitting has been rotated.

As can also be seen from the illustration in FIGS. 5 and 6, the magnet 12 in the above-described embodiments shown in FIGS. 1 to 4 of the invention is rotated by a known rosette-shaped protective fitting 42, which can rotate and is described, for example, in the German utility model G 93 17 012 by the Applicant. In this refinement of the locking device according to the invention, a cup-shaped outer part 44, which can be rotated, is disposed on the outside of the door 4 and can be latched and unlatched by a configuration (indicated schematically in FIGS. 5 and 6) of disconnecting pins 46 with respect to an inner part 48, which is fixedly connected to the door 4, using a suitable key, is connected in its center of rotation to the magnet 12 with a shaft 50 in a manner which is rigid in terms of rotation, the shaft 50 preferably acting in the center of rotation of the magnet 12.

The rosette-shaped protective fitting 42 is reproduced only schematically in FIGS. 5 and 6, and its details are known from the above-mentioned utility model. The embodiment of the invention illustrated in FIGS. 5 and 6 has a very compact and robust configuration and, owing to the very large number of encoding possibilities of the rosette-shaped protective fitting 42, has a very good protective action.

The position, illustrated in the figures of the magnet 12 within the housing 14 for release and latching is only exemplary and can be changed, if desired, depending on the respective requirements for the displacement path by corresponding polarization of the magnet. It is thus conceivable, for example, to use a quadrupole magnet in order to obtain a corresponding reduction in the angle of rotation between the latching position and the release position.

Figure 7:
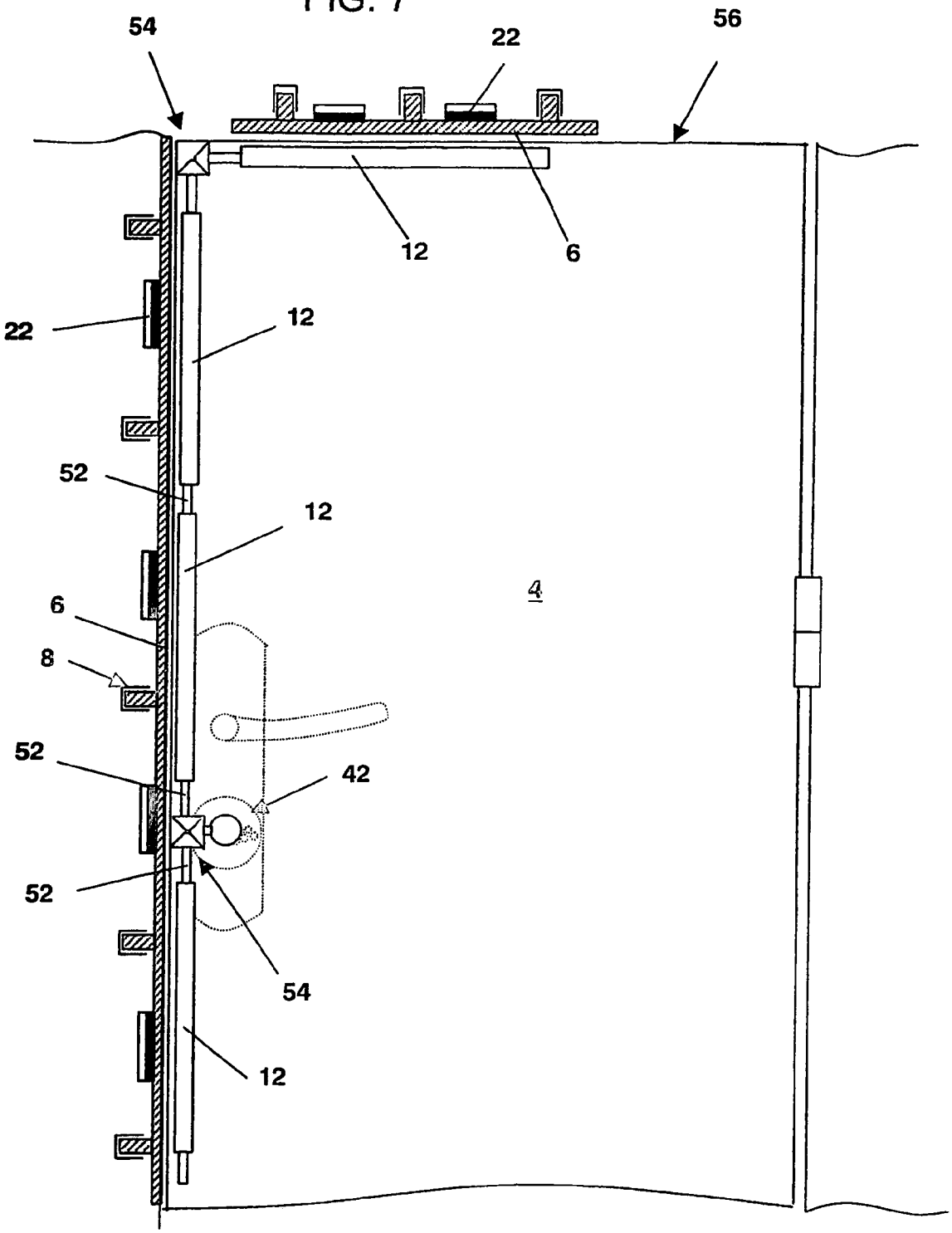
FIG. 7 is a diagrammatic illustration of a door having a fourth embodiment of the locking device according to the invention, in the case of which the axes of rotation or longitudinal axes of the rod-shaped permanent magnets extend along the door edges in the vertical and also in the horizontal direction and are driven by angular gear mechanisms.

In accordance with a further embodiment of the invention illustrated in FIG. 7, one or preferably even two or more rod-shaped magnets 12 are disposed in the region of the door edge, the longitudinal axis of the permanent magnets 12 extending substantially parallel to the door edge.

As can also be seen from the illustration in FIG. 7, the magnets 12 are coupled to one another via corresponding shafts 52 and are driven by known angular gear mechanisms 54, which are in the form of bevel gear mechanisms in the embodiment in FIG. 7.

In addition to the magnets 12 extending in the vertical direction, one or more magnets 12 extending in the horizontal direction may be disposed in the region of an upper edge 56, which interact with one or more locking elements 6 in the same manner as the other magnets, the locking elements 6 being accommodated in schematically illustrated guides 8 such that they can move and being attracted, depending on the position of rotation of the magnets 12, in the above-described manner counter to a resetting force, which is produced, for example, by further permanent magnets 22, so as to latch the door 4.

In this embodiment of the invention too, the rotation of the permanent magnets 12 from the release position to the latching position is preferably produced by a rosette-shaped protective fitting 42.

In this embodiment of the invention, the locking elements 6 are preferably in the form of continuous striking plates, to which a sealing element is advantageously fixed, the sealing element extending over the entire length of a locking element 6, but not being illustrated in FIG. 7 for illustrative reasons.

Figure 8:
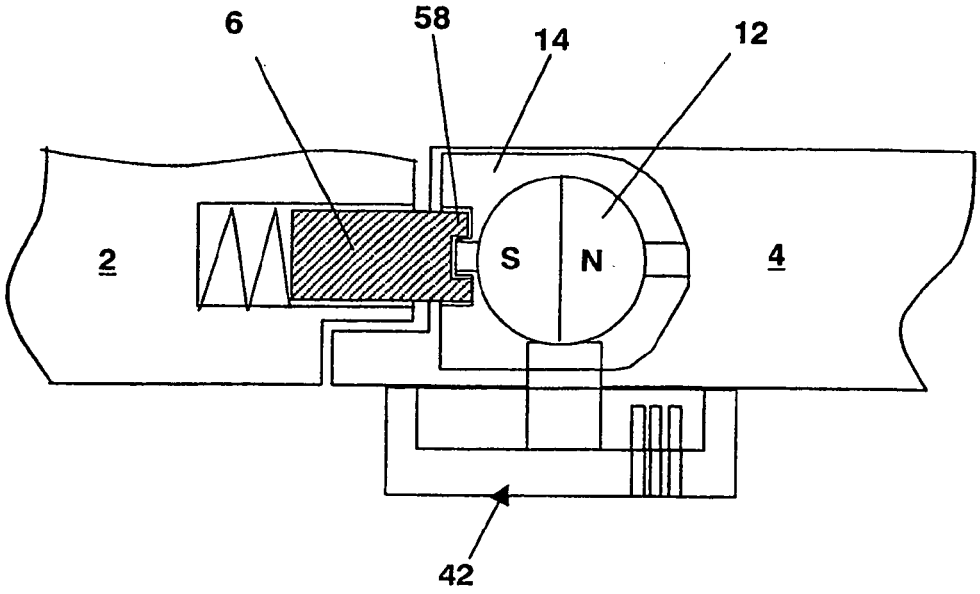
FIG. 8 is a diagrammatic, cross-sectional view of a fifth embodiment of the invention having rod-shaped permanent magnets extending along the door edges, in which the locking element is accommodated in a guide within the door frame and is forced away from the door edge into the interior of the door frame by an spring-elastic device, in the latching position.
Figure 9:
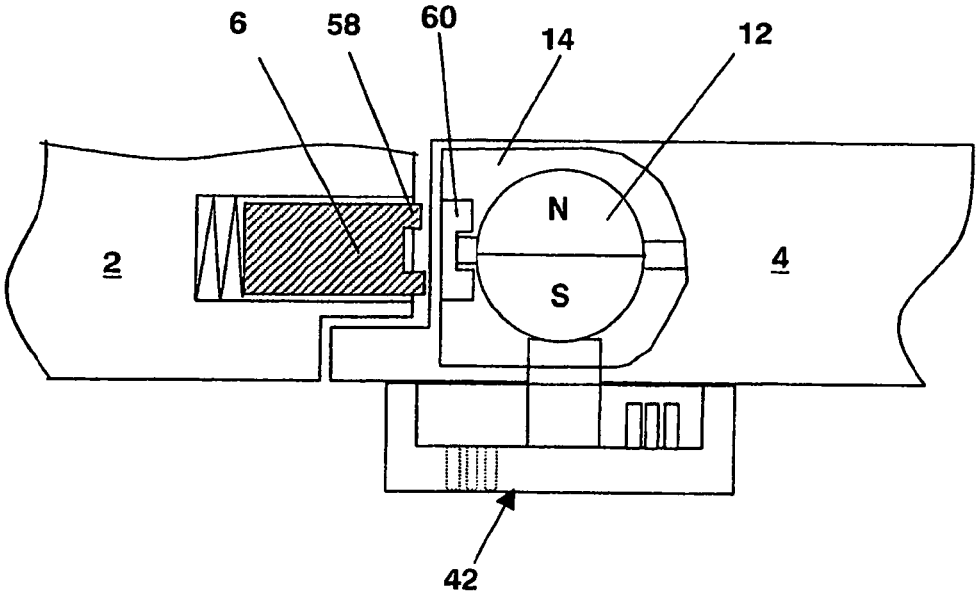
FIG. 9 is a diagrammatic, cross-sectional view showing the embodiment from FIG. 8 in the release position.

As can be seen from the cross-sectional view of the embodiment from FIG. 7 in FIGS. 8 and 9, the locking element 6, which extends over the entire length of the door or at least over a section of the door, engages in a correspondingly configured longitudinal groove-like cutout 60 in the door 4 with correspondingly tab-shaped projections 58 in the latching position shown in FIG. 8 and thus forms an interlocking connection over the entire length of the door edge in the latching position.

In the release position illustrated in FIG. 9, the locking element 6, as a deviation from the illustration in FIG. 7, is drawn into the door frame 2 by a spring-elastic device in the form of a tension spring 36.

As can be seen from the illustration in FIGS. 8 and 9, the permanent magnet 12 in this embodiment of the invention is likewise accommodated in the housing 14, which can be inserted in a correspondingly shaped pocket in the region of the door edge and preferably extends over the entire length of each individual magnet 12.

In order to obtain automatic latching of the door described in FIGS. 7 to 9, a self-latching mechanism 62 is preferably disposed in the door in the region of the door edge, the mechanism 62 contains a toothed rack 64, which can be moved in the direction of double arrow 66 in a guide (not described in any more detail).

Figure 10:
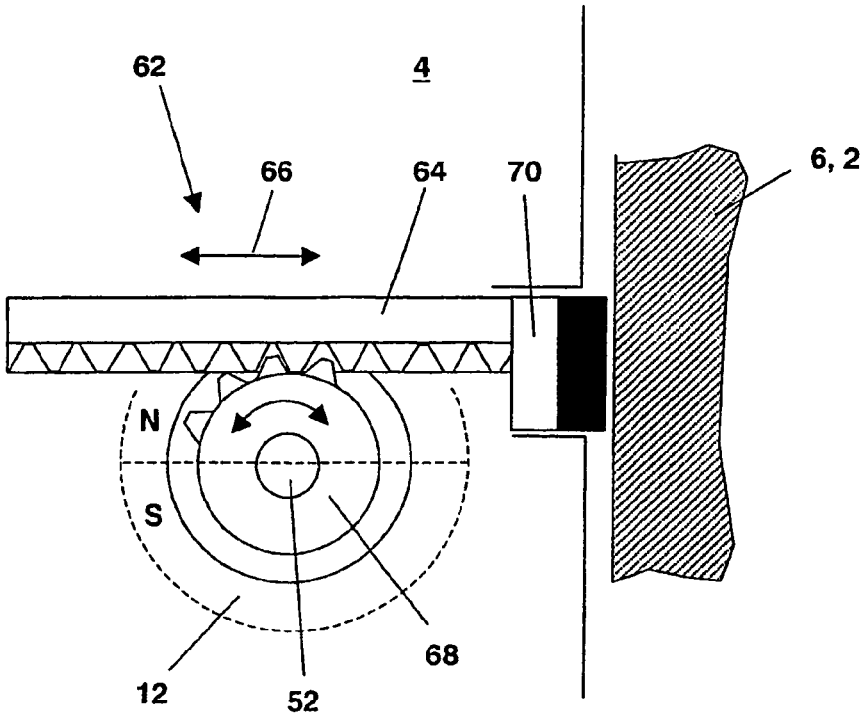
FIG. 10 is a diagrammatic, illustration of a self-latching device for the purpose of automatically latching the door once said door has been closed.

The toothed rack 64 is in toothed engagement with a pinion or toothed wheel 68, which is coupled, such that it is fixed against rotation, to one of the shafts 52 or else directly to the magnet 12 drawn schematically in FIG. 10 using dashed lines.

That end of the toothed rack 64 which is close to the door frame 2 is preferably connected to a third permanent magnet 70, which is moved in the direction towards the locking element 6 or door frame 2 when the door 4 is closed owing to the interaction with the locking element 6, or with a corresponding magnetizable part of the door frame 2, and, as a result, sets the toothed wheel 68 in rotation, the toothed wheel 68 for its part rotating the magnet 12 from the release position to the closed position.

In order then to again cancel the latching of the door thus produced, the magnet 12 is then rotated back to the release position by the associated gear mechanism 54 and the actuating device, which may take place generally only with the aid of the associated key when a rosette-shaped protective fitting 42 is used.

In order to make possible free rotation of the toothed wheel 68 when the actuating element or protective fitting 42 is blocked, the gear mechanism or else the rosette-shaped protective fitting 42 may be provided with a correspondingly configured free running state or a one-way coupling, which is not illustrated in any more detail in the drawings for illustrative reasons.

Figure 11:
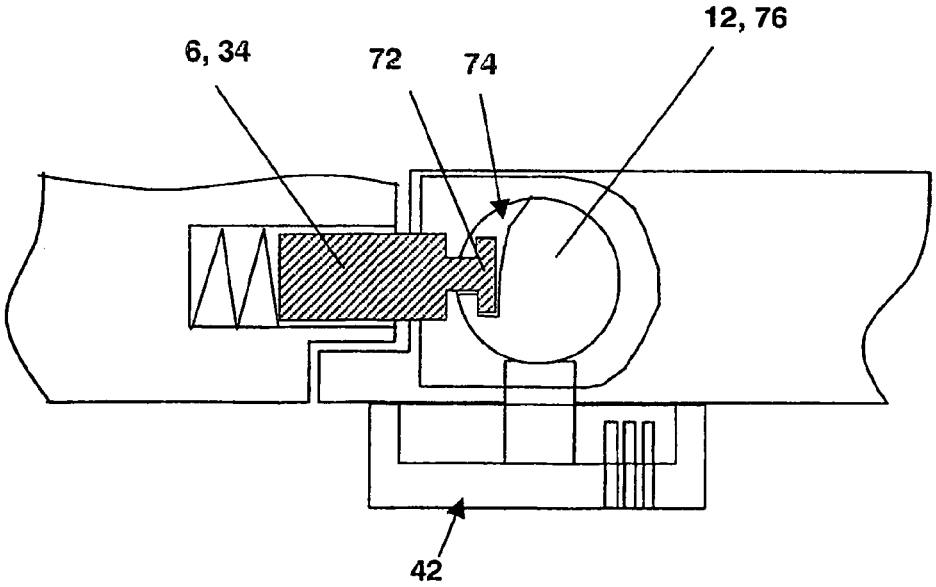
FIG. 11 is a diagrammatic, illustration of a seventh embodiment of the invention, in which an additional mechanical latching in the closed position of the door is produced by a T-shaped head, which is formed on the locking element and engages in an associated, groove-like opening, which extends towards the center of rotation of the permanent magnet.

In accordance with the embodiment of the invention illustrated in FIG. 11, the locking element 6 in the embodiment from FIG. 7 has an end section, which is provided with a T-shaped head 72 and engages, in the latching position of the magnet 12, in a groove-like or pocket-like cutout 74, which engages in the magnet 12 or in a section 76, which is connected to the magnet 12 such that it is fixed against rotation and is made from a cured material, in order to ensure additional mechanical latching of the door 4 in the latching position of the magnet.

Finally, in accordance with a further embodiment of the invention, which is indicated schematically in FIG. 4, an electrical coil 80 may be formed around the permanent magnet 12, the coil turns of the electrical coil 80 being aligned such that the magnetic field produced rotates the permanent magnet 12 from the latching position to the release position and back depending on the direction of the electrical current flowing through the coil 80. The coil 80 is only shown in FIG. 4 for illustrative reasons. The coil makes it possible for the locking device 1 according to the invention to be provided with electrically controlled emergency latching or emergency unlatching, which makes possible, for example in the event of a fire, central opening of all of the emergency exit doors of a building.

I claim:

1. A magneto-mechanical locking device on a movable door disposed opposite a stationary frame comprising:

a locking element disposed on the stationary frame and made from a magnetizable material;

a permanent magnet accommodated on the door, said permanent magnet being rotatable from a first release position where substantially no magnetic force effect is exerted on said locking element, to a second latching position where said locking element is attracted by a magnetic force effect of said permanent magnet for locking the door; and said locking element having projections for engaging, in the second latching position, in associated receptacles of the door for producing an interlocking connection.

2. The locking device according to claim 1, wherein said projections are formed as pins or tabs, which engage in the associated receptacles of the door being either holes or grooves in the door.

3. The locking device according to claim 1, wherein said locking element is formed as a striking plate being movable relative to the stationary frame and forms, in the second latching position, a connection being either a force-fitting connection or an interlocking connection with said permanent magnet, said connection locking the door.

4. The locking device according to claim 1, wherein said locking element is a locking bolt and the stationary frame has a guide formed therein in which said locking bolt is received and linearly moves in said guide.

5. The locking device according to claim 1, further comprising further permanent magnets, which produce less magnetic effect than said permanent magnet in the second latching position and, in the first release position, move said locking element away from the door while canceling a latching effect, said further permanent magnets disposed on the stationary frame on that side of said locking element which is remote from the door.

6. The locking device according to claim 1, further comprising a spring-elastic device for forcing said locking element away from the door.

7. The locking device according to claim 1, wherein said permanent magnet is a substantially rod-shaped magnet polarized in a direction extending substantially perpendicular to a longitudinal axis of said permanent magnet.

8. The locking device according to claim 7, further comprising a housing substantially closed in a circumferential direction and made from a further magnetizable material, said rod-shaped magnet disposed in said housing.

9. The locking device according to claim 8, wherein said housing has a cutout formed therein, and in the second latching position, said locking element engages in said cutout.

10. The locking device according to claim 8, wherein said housing has a cylindrical hole formed therein, and said permanent magnet is accommodated in said cylindrical hole such that it can be rotated.

11. The locking device according to claim 8, wherein said longitudinal axis of said permanent magnet extends substantially perpendicular to a plane of the door.

12. The locking device according to claim 7, further comprising an actuating element driving said permanent magnet, said actuating element can rotate and grips said permanent magnet in a region of its center of rotation.

13. The looking device according to claim 12, wherein said actuating element is formed by at least one device selected from the group-consisting of a knob disposed on an outside of the door, a protective fitting, an electromechanically lockable coupling and a locking cylinder accommodated on the door.

14. The locking device according to claim 7, wherein said longitudinal axis of said rod-shaped magnet extends substantially parallel to a door edge in a vertical or horizontal direction.

15. The locking device according to claim 14, further comprising a gear mechanism for driving said permanent magnet.

16. The locking device according to claim 1, wherein said permanent magnet is one of at least two permanent magnets having shafts for coupling to one another, such that said permanent magnets are fixed against rotation.

17. The locking device according to claim 1, further comprising a self-latching mechanism for automatically rotating said permanent magnet from the first release position to the second latching position when the door is closed.

18. The locking device according to claim 17, wherein:

said self-latching mechanism has a toothed wheel coupled to said permanent magnet; and said self-latching mechanism contains a toothed rack accommodated in a region of a door edge, can move relative to the door, is in toothed engagement with said toothed wheel and is moved in a direction of the stationary frame once the door has been closed, owing to an influence of the magnetic force effect and, in the process, rotates said permanent magnet to the second latching position.

19. The locking device according claim 18, further comprising a third permanent magnet for producing the magnetic force effect, said third permanent magnet is fixed to said toothed rack and Interacts with said locking element and/or a magnetizable part of the stationary frame.

20. The locking device according to claim 8, further comprising an electrical coil disposed around said permanent magnet and, owing to said electrical coil, said permanent magnet can be rotated between the second latching position and the first release position depending on a direction of an electrical current flowing through said electric coil.

21. The locking device according to claim 1, further comprising a transverse bolt accommodated on the door, said transverse bolt being displaceable in a transverse direction with respect to the door and interacting with said permanent magnet such that said transverse bolt is likewise moved to a latching position when said permanent magnet is rotated from the first release position to the second latching position, as a result of a magnetic force effect.

22. The locking device according to claim 15, wherein said gear mechanism is a bevel gear mechanism.

* * * * *